United States Patent [19]

Coggin et al.

[11] 4,428,090

[45] Jan. 31, 1984

[54] PALLET SCRAPER

[76] Inventors: Michael E. Coggin, 1524 South Price #101, Tempe, Ariz. 85281; Charles K. Everett, 1221 W. 6th Dr., Mesa, Ariz. 85201; Donald D. Schwellenbach, 4520 W. Bryce La., Glendale, Ariz. 85301

[21] Appl. No.: 353,901

[22] Filed: Mar. 2, 1982

[51] Int. Cl.[3] ..... B08B 1/02

[52] U.S. Cl. ..... 15/93 C; 198/499

[58] Field of Search ..... 15/93 R, 93 C, 257.5, 15/257.51, 4; 198/499; 425/232, DIG. 116

[56] References Cited

U.S. PATENT DOCUMENTS

| | | | |
|---|---|---|---|
| 1,045,677 | 11/1912 | Collins . | |
| 1,691,181 | 11/1928 | Coats et al. . | |
| 2,333,285 | 11/1943 | Wellnitz | 15/93 C |
| 2,368,114 | 1/1945 | Cartlidge | 198/499 |
| 2,637,057 | 5/1953 | Moore | 15/93 C |
| 2,724,137 | 11/1955 | Beals | 15/4 |
| 2,752,621 | 7/1956 | Warsaw | 15/93 |
| 2,799,879 | 7/1957 | Frese | 15/93 C |
| 3,110,050 | 11/1963 | Sainio | 15/93 |
| 3,217,348 | 11/1965 | Simmons | 15/93 |
| 4,365,706 | 12/1982 | Bright | 198/499 |

*Primary Examiner*—Edward L. Roberts

*Attorney, Agent, or Firm*—LaValle D. Ptak

[57] ABSTRACT

A pallet cleaning device used to clean pallets moved from a pallet magazine or supply hopper to the molding section of a concrete block molding machine includes a frame for mounting the pallet cleaning device directly in front of the pallet magazine of the block making machine. A first sub-frame is pivotally mounted on the main frame and is biased by gravity against a stop located on the main frame to establish the position of a set of four pallet scraper blades mounted side by side across the path of a pallet passing beneath the device. A blade holder is pivotally mounted on the sub-frame to locate the scraper blades at an angle; so that they contact the pallet on a line located behind the vertical projection of the pivot mounting of the blade holder on the sub-frame in the direction of travel of a pallet for cleaning. Resilient springs are used to bias the scraper blade holder against a stop engaging the sub-frame to locate the scraper blades. These springs provide a first force perpendicular to the pallet surface at the point of blade contact and a second force in a plane parallel to the pallet surface in the direction of movement of the pallet beneath the cleaning device. The location of the springs relative to the second pivot and the angle at which the blades engage the pallet surface cause the first force to be substantially greater than the second force.

12 Claims, 4 Drawing Figures

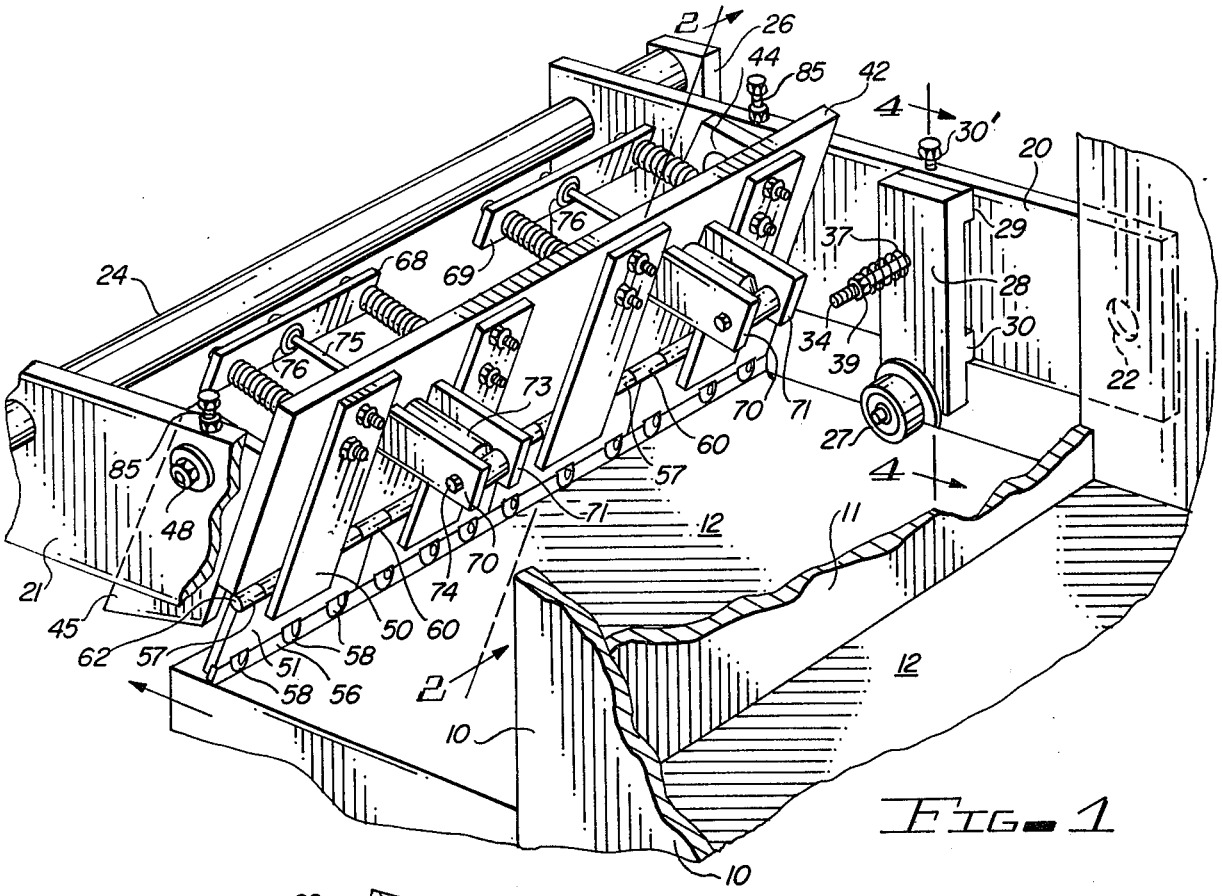
FIG. 1
FIG. 2
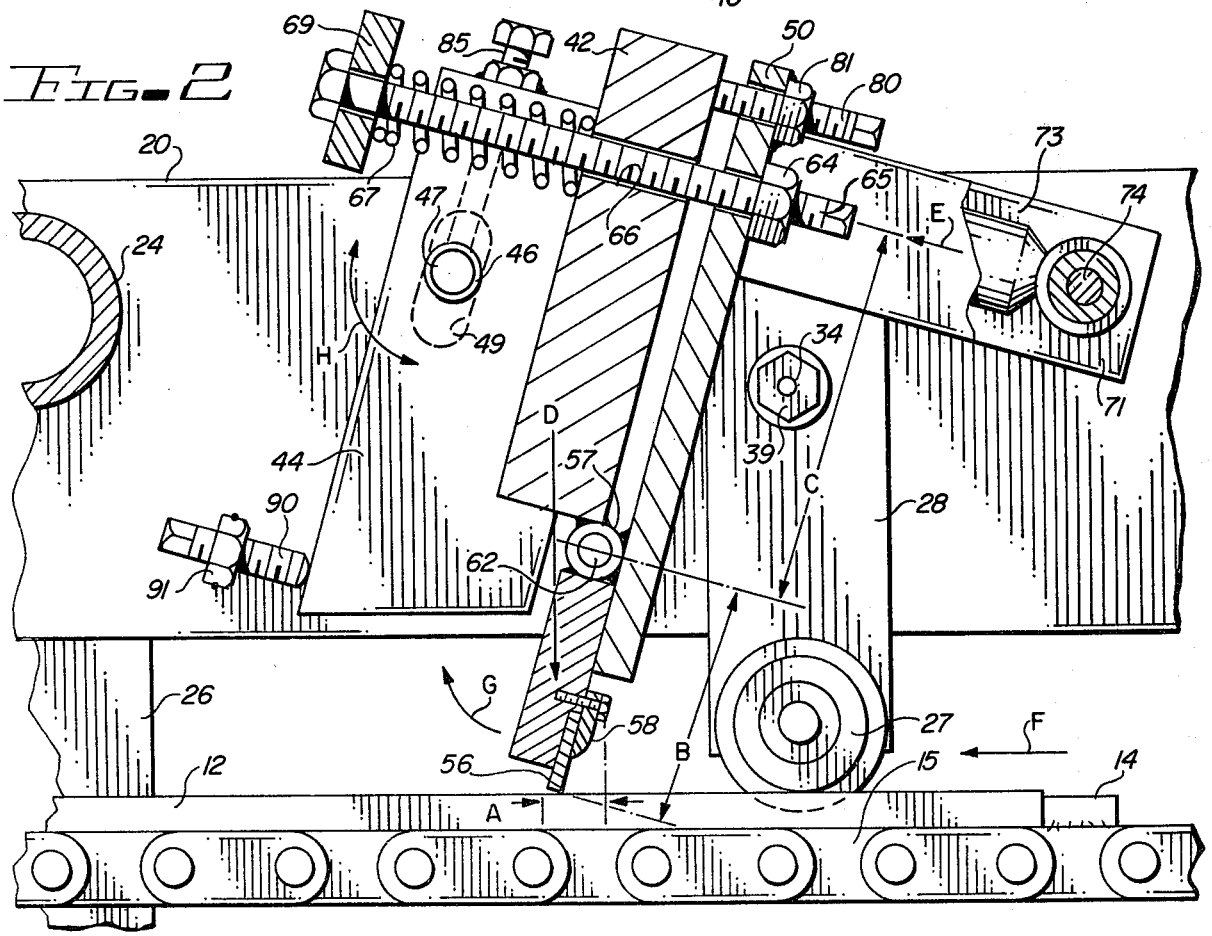

PALLET SCRAPER

BACKGROUND OF THE INVENTION

In automatic concrete block-making machines, the blocks are molded on the upper surfaces of flat, steel pallets supplied from a pallet magazine to the molding section of the machine. After molding, the pallets, with newly formed blocks on them, are moved out of the machine to a point where the blocks are cured. After curing, the blocks are removed from the pallets which then are returned to the pallet magazines for reuse in the cycle of operation of the machine.

After blocks have been formed on a pallet, there is a build-up of aggregate concrete flash which sticks to the pallets; and if the pallets are continuously reused without removing this flash, a substantial build-up of encrusted material develops. This build-up material results in misshapen blocks and further can interfere with the most efficient operation of the concrete block-making machine. Therefore, the flash must be removed. Often, this is done by periodically running all of the pallets through a separate pallet-cleaning machine. This results in lost down time and expense while the pallets are being cleaned. In addition to the down time, there also is a substantial expense incurred in the provision of such separate cleaning machines. Generally, they require additional motors; cams, or hydraulic controls; belts or chain drives; and necessarily must be of relatively heavy construction because of the nature of the operation being effected by them. Consequently, such machines are not readily portable and are relatively expensive.

A typical stand-alone machine for cleaning pallets is shown in the Patent to Frese, U.S. Pat. No. 2,799,879. This machine requires a separate motor and reciprocating pallet transport mechanism to move the pallets beneath a spring-loaded scraper blade which is urged downwardly onto the pallet surface by a number of stiff compression springs. Because of the substantial downward force exerted on the pallet, the mechanism for moving the pallet beneath the scraper blades necessarily is a heavy duty mechanism. The pallets are fed one at a time into the device, and the scraper blade is raised momentarily as each new pallet is moved into position beneath the blade. After the pallet is in position, the blade is lowered onto the palet surface which then is moved beneath the blade for cleaning. The machine of Frese is expensive, and it is not intended as a continuous cleaning machine used in conjunction with the pallet-feed mechanism of an automatic concrete block-making machine. Consequently, pallets which are becomeing increasingly encrusted with aggregate are allowed to accumulate until the periodic cleaning of such pallets is effected from time to time in a machine such as shown in the Frese Patent.

In an attempt to clean pallets each time they are fed from a pallet magazine to the molding section of a concrete block-molding machine, a variety of pallet-cleaning devices have been developed in the past. One such device is disclosed in Patent No. 3,217,348. This device is a transverse reciprocating scraper blade driven by a separate motor which moves the blade back and forth across the pallet as the pallet moves in its path from the pallet magazine to the molding portion of the machine. The motor which drives the scraper blade is synchronized in its operation to start and stop in conjunction with the machine operation, and the mechanism includes additional cam and roller assemblies for raising and lowering the pallet cleaner frame as pallets are moved beneath and through the pallet cleaner portion of the machine. A large number of additional moving parts are required in this relatively cumbersome device, thereby, subjecting it to the potential of substantial maintenance expense and down time.

An attempt at a static "plow-shaped" pallet scraper is disclosed in U.S. Pat. No. 2,752,621. This pallet scraper mounts two pallet-scraping blades at an angle 90 degrees to one another with the point pivotally mounted adjacent the pallet magazine from which the pallets are fed as they pass through the machine. Long, rigid blades are employed, and the device has a frame which is spring biased downwardly to apply pressure to the surface of pallets moving beneath it. If a pallet passing through the device is warped, incomplete cleaning occurs, and the heavy downward force applied to the pallet also places a substantial strain on the conveyor mechanism for moving the pallet through the device.

Another pallet-cleaning device employed in the past is shown in U.S. Pat. No. 2,637,057, which requires a special driving mechanism and operates to reciprocate a pallet-scraper blade transversely back and forth across the pallet as it travels through the machine. In this respect, this machine is similar in its operation to the machine shown in U.S. Pat. No. 3,217,348. Rotating the scraper blades is shown in U.S. Pat. No. 1,045,677, and chipping and vibrating pallet-cleaning devices are shown in U.S. Pat. Nos. 2,724,137 and 3,110,050. All of these patents require additional moving, mechanical parts in order to accomplish the cleaning operation.

None of the above patents have a provision for protecting the blades of the pallet-cleaning devices in the event the mechanism for moving the pallet should reverse from its normal direction. Such reversal, however, occurs frequently in the operation of concrete block-making machines and causes chipping or breaking off of the scraper blades, for example, when it occurs in a machine such as the one shown in U.S. Pat. No. 3,217,348.

It is desirable to provide a pallet cleaning or scraping device which is relatively inexpensive, which works continuously in conjunction with the operation of a concrete block-making machine, which applies minimum forces in the direction of travel of pallets through the machine to thereby reduce the strain on the pallet moving mechanism, and which is not subject to damage in the event of an intentional or accidental reversal of direction of travel of pallets through the pallet cleaning device.

SUMMARY OF THE INVENTION

Accordingly, it is an object of this invention to provide an improved pallet scraper.

It is another object of this invention to provide an improved pallet scraper having a minimum number of movable parts.

It is an additional object of this invention to provide an improved pallet scraper capable of operation to continuously clean pallets as they are fed from the pallet magazine to the mold box of a concrete block-making machine.

It is a further object of this invention to provide a pallet scraper with pivoted blade holders.

It is yet another object of this invention to provide an improved pallet scraper with spring-biased, pivoted blade holders capable of movement in the direction of travel of pallets to permit warped pallets to pass through with a minimum of resistance, while at the same time presenting maximum downward force for the removal of accumulated aggregate build-up on the pallet surfaces.

It is still another object of this invention to provide an improved pallet scraper which prevents jamming in the event the pallet movement direction is reversed.

In accordance with the preferred embodiment of this invention, a device for cleaning pallets of the type used in concrete block-making machines includes a frame for mounting in a fixed location relative to the path of travel of pallets to be cleaned. A pallet scraper blade is mounted in a holder in a scraping position near the surface of a pallet to be cleaned. The holder is yieldably mounted on the frame to provide a first force perpendicular to the pallet surface and a second force parallel to the plane of the surface of the pallet in the direction of movement of a pallet through the pallet cleaning device. The blade and holder yield to forces greater than such first and second forces to prevent jamming of the machine in which the pallet cleaning device is located and to minimize damage to the scraper blade.

BRIEF DESCRIPTION OF THE DRAWINGS

FIG. 1 is a perspective view of a preferred embodiment of the invention;

FIG. 2 is a cross-sectional view taken along the lines 2—2 of a portion of the embodiment shown in FIG. 1 to more clearly illustrate details of the construction of such embodiment;

DETAILED DESCRIPTION

Figure 3:
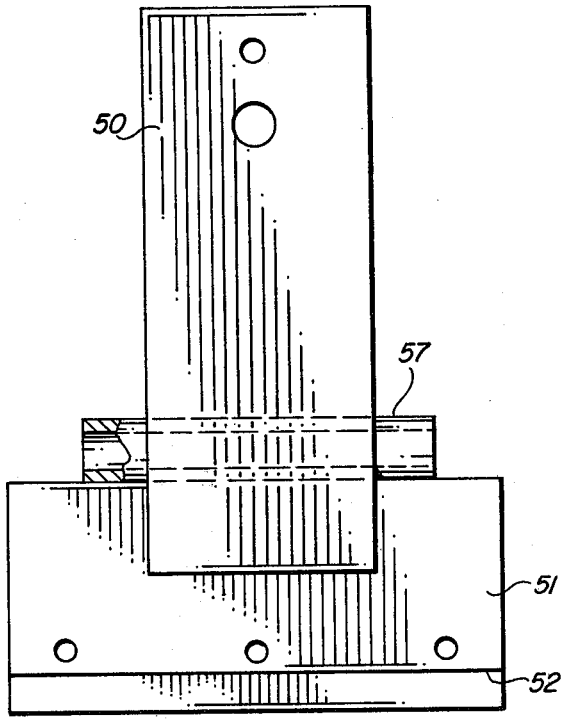
FIG. 3 illustrates details of one of the parts of the embodiment shown in FIGS. 1 and 2.

Reference new should be made to the various figures of the drawings in which the same reference numbers are used throughout the different figures to designate the same components. Reference, initially, should be made to FIGS. 1 and 2 which illustrate a pallet scraper for use in conjunction with concrete block-making machines. Although the pallet scraper shown in FIGS. 1 and 2 ideally is used continuously in the normal operation of a concrete block-making machine, it should be understood that it also can be employed as part of a separate pallet-cleaning machine if so desired. However, since it is highly desirable to continuously clean the upper surfaces of pallets as they are fed from a pallet magazine to the mold box of a concrete block-making machine, the operation of the pallet-cleaning device shown in the drawings will be described as it is used in conjunction with such a standard machine.

Since the details of the concrete block-making machine are of no importance here and since the pallet-cleaning device may be used with different types of concrete block-making machines, no details of such machines have been shown in the figures of the drawings. Generally, such machines include a pallet magazine or pallet box 10 which is shown partially cut away in FIG. 1. A large number of pallets are vertically stacked in such a box which has a space of sufficient height on its front surface 11 to permit the passage of a single pallet 12 outwardly therethrough. This slot under the lower surface of the front side 11 generally is wide enough to prevent the passage of two pallets through it, but it is of sufficient width to allow a pallet with accumulated debris on it to pass through unhindered. A similar slot is provided in the rear side (not shown) of the pallet box 10 to permit chain dogs or lugs 14 carried by an endless chain 15 to move the pallets from the pallet magazine 10 toward the mold box of the machine. These elements which have been described thus far are conventional and are used in most continuously operating concrete block-making machines, so that no further details of the manner of driving the chain 15 and its relative location with respect to other elements of the concrete block-making machine is considered necessary.

The pallet cleaning device which is illustrated most clearly in FIGS. 1 and 2 is mounted between the pallet magazine 10 and the mold box (not shown) of the concrete block-making machine. This mounting is accomplished by placing the cleaning device in a main frame consisting of a pair of parallel side frame members 20 and 21 attached at one end by means of bolts or other suitable fasteners to the opposite sides of the pallet magazine 10. In FIG. 1, the far side frame member 20 is shown in its entirety including a hole 22 through which an attaching bolt may be placed to bolt the end of member 20 to the side of the pallet magazine 10. The frame member 21 is a mirror image of the member 20, but it has been cut away to reveal details of the pallet scraper mechanism. The ends of the members 20 and 21 of the frame which are nearest the mold box of the concrete block-making machine are interconnected by a bar 24 which extends through holes near the upper edges of the members 20 and 21 and is welded rigidly in place in these holes. The bar 24 extends beyond the outer surfaces of the side-frame members 20 and 21 where it is attached to a pair of downwardly extending legs 26 (only one of which is shown in FIGS. 1 and 2). These legs, on opposite sides of the frame members 20 and 21, then are attached to the main frame of the concrete block-making machine in any suitable manner (not shown).

As the pallets 12 are moved out of the pallet magazine 10 to a position to be scraped or cleaned by the scraper mechanism shown in FIGS. 1 and 2, they pass under a pair of hold-down rollers 27, mounted opposite one another on the side frame members 20 and 21. Only the hold-down roller 27 and its mounting bracket 28 attached to the side frame member 20 is illustrated. A similar roller mounted in a mirror image position on the inside of the cut-away portion of the bracket 21 is placed on the opposite side of the path of travel of the pallets 12 as they exit from the pallet magazine. These rollers prevent upward movement of the pallets 12 to prevent the chain dogs 14 from slipping under the pallets 12 as they move into position to be engaged by the scraper blades in the scraper device.

The rollers 27 are rotatably mounted on a shaft located at the lower end of a rigid bracket 28 which has an upper extension 29 and a lower extension 30 to engage the inner surface of the members 20 and 21. The details of this roller and bracket construction are shown most clearly in the sectional view of FIG. 4. Initial adjustment of the vertical location of the roller 27 during operation of the machine is effected by first moving an adjusting screw 30' upward out of a short vertical slot 32 formed through the wall 20. A pin 33 is rigidly attached to the projection 29 and extends through the slot 32. A new, clean pallet 12 then is placed beneath the roller 27 and also beneath the scraper blade in the position shown in FIG. 1. The roller is raised. With the roller 27 resting on the upper surface of the pallet 12, the screw 30′ is turned downwardly until it just touches the pin 33. This permits a loose engagement with the pin 33 but prevents upward movement of the pin 33 with the slot 32.

The bracket 28 then is attached to the side-frame member 20 (and also is similar bracket to the side-frame member 21) by means of a long bolt 34 passing through an oversized hole 35 in the side-frame member 20 and tightened against a compression spring 37 located between a nut 39 on the end of the bolt 34 and the interior of the enclosure formed between the side-frame members 20 and 21. The amount of tension or force with which the bracket 28 is pressed against the inside wall of the side-frame member 20 is adjusted by rotating the nut 39 either to increase or to decrease the compression of the spring 37.

Figure 4:
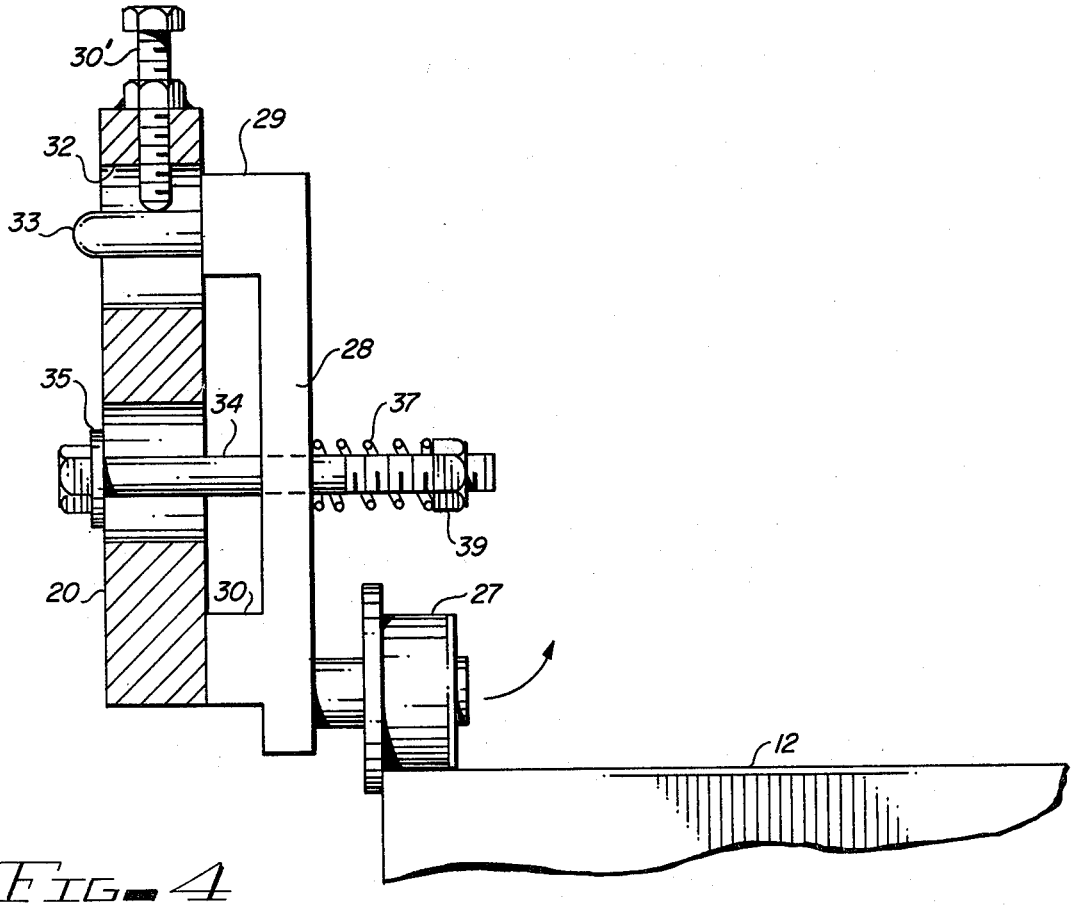
FIG. 4 is a cross-sectional view taken along the lines 4—4 of the embodiment shown in FIG. 1.

Whenever a warped or bent pallet 12 passes beneath the roller 27 to cause downward force on the roller, the bracket 28 and roller 27 pivot about the axis formed by the pin 33 inwardly and upwardly in the direction of the arrow shown in FIG. 4. When the bend or warp passes, the spring 37 forces the bracket 28 back to the normal operating position shown in FIG. 4 which is the normal operating position.

The scraper device itself comprises a sub-frame consisting of a rectangular plate 42 having a pair of extensions 44 and 45 welded to each end. These extensions are parallel to the inner surfaces of the side members 20 and 21 of the main frame and are pivotally mounted on bushings 46 near their upper ends by threaded pivot pins 47, passing through the bushings 46 in the extensions 44 and 45, respectively. These pins extend through short, vertical slots 49 in the respective side members 20 and 21. The slot 49 in the side member 20 is illustrated in dotted lines In FIG. 2. This slot permits vertical adjustment of the location of the pins 47 in a manner similar to the adjustment of the pin 33 described previously for adjusting the position of the hold-down roller 27. After adjustment, the pins 47 are secured in place in the slots 49 by tightening corresponding nuts 48 to clamp the pins 47 in the slots 49.

The scraper blade itself is comprised of four separate, parallel scraper blades to accommodate unevenness in any pallet 12 passing beneath the scraper and to maximize the effectiveness of the scraping action of the apparatus. Each of the scraper blades is held in an inverted, T-shaped scraper blade holder consisting of a flat, vertical upper plate 50 to which is attached an elongated, horizontal, flat plate 51 having a notch 52 along its lower edge to hold a carbide steel scraper blade 56 (shown most clearly in FIGS. 1 and 2). The details of this scraper-blade holder are shown most clearly in FIG. 3. The two portions 50 and 51 of the holder are welded together and to a length of hollow tube section 57 which comprises a portion of a hinge used to pivot the scraper-blade holder and to secure the two parts 50 and 51 together. The relative location of these parts is shown in cross section in FIG. 2.

As shown most clearly in FIG. 1, short tubular sections 60, which are made of material identical to the tubular sections 57 used on each of the blade holders, are welded to the plate 42 in alignment with the axis of the sections 57 on each of the blade holders. These sections 60 are located on opposite sides of each of the tubes 57 for each of the four blade holders. A rod 62 extends through all of the sections 57 and 60 from one end of the plate 42 to the other and may be held in place in any suitable manner such as by a cotter pin or the like. Removal of the rod 62 permits subsequent removal of any one or more of the blade-holder members 50/51 for subsequent repair or replacement. When the rod 62 is in place, as shown in FIGS. 1 and 2, however, all of the blade holders 50/51 are pivotally held in place at the lower edge of the plate 42.

To provide for resilient engagement of the scraper blades 56 at the lower edges of each of the blade holders 50/51, the upper ends of each of the plates 50 are attached to a spring-loaded, threaded bolt 65 (shown most clearly in FIG. 2). This bolt extends through an enlarged hole 66 in the sub-frame plate 42 for each one of the plates 50. A compression spring 67 bears against the opposite surface of the plate 42 and is compressed between that surface and a facing surface of one of a pair of elongated, rectangular plates 68 or 69 (see FIG. 1). Adjustment of the compression of each of the springs 67 is effected by turning the bolt 65 in one direction or another through a nut 64 bearing against the plate 50 with which each such bolt is associated. The holes 66 through the plate 42 are made large enough to accommodate a free movement of the shaft of the bolt 65 through the plate 42 as the blade holder 50/51 pivots about the hinge pin 62 described previously.

As shown in FIG. 1, the blade holders 50 and 51 are arranged into two pairs of blade holders. A pair of parallel, vertical plates 70 and 71 extend outwardly between the blade holders of each pair from the face of the sub-frame member 42. The cylinder of a shock absorber 73 (of conventional type) is attached between each of the pairs of plates 70 and 71 by a bolt 74 (FIGS. 1 and 2). An actuating rod 75 attached to the piston of each shock absorber 73 passes through a corresponding enlarged hole (not shown) in the plate 42 and is secured by a nut (not shown) to the opposite side of the corresponding plate 68 or 69 in a manner similar to the manner in which the bolts 65 are secured to the plates 68 and 69. A projection 76 is secured near the end of each piston rod 75 and bears against a rubber bushing or washer on the inside surface of each of the plates 68 and 69. As the plates 68 or 69 move toward the left-hand surface of the sub-frame plate 42 (as viewed in FIG. 2), the corresponding rod 75 moves the piston of the shock absorber 73 inwardly. As the plate 68 or 69 moves away from the plate 42, the piston in the corresponding shock absorber 73 moves back out of the shock absorber 73 in a conventional fashion in unison with movement of the corresponding springs to dampen the spring action. The holes accommodating the bolts 65 and the ends of the rods 75 in each of the plates 68 and 69 are made large enough to permit twisting or non-parallel movements of these plates in the event one of the pair of blade holders 50/51, which operate on opposite ends of the plates 68 or 69, is pivoted to a greater extent than the other to cause a rocking movement or action of the corresponding plates 68 or 69.

The shock absorbers 73 prevent the blade holders 50/51 from snapping back after the corresponding springs have been compressed by a warped pallet or excessive build-up on a pallet moving through the machine. The shock absorbers also minimize damage to the brittle scraper blades 56 by snubbing or dampening the action of the blade movement.

Initial adjustment of the individual blade holders 50/51 and alignment of the blades 56 carried by each of the four different blade-holder assemblies is effected by rotating a set screw 80 through a nut 81 secured to the upper ends of each of the plates 50 to bear against the surface of the plate 42 (as shown most clearly in FIG. 2). It is apparent that the action of the compression spring 67 pushing against the right-hand surface of the plates 68 and 69 (as viewed in FIG. 2) causes the blade-holder assemblies 50/51 to tend to rotate in the counter-clockwise direction as viewed in FIG. 2. Thus, the left-hand end of the set screw 80 tightly engages the plate 42 to set the limit of this counter-clockwise rotation for each blade holder. An initial adjustment of all four of the set screws 80 is made to fine tune the angle of tilt of each of the blades 56 and to align the blades 56 with one another across the width of the scraper mechanism.

The initial set-up of the scraper mechanism for its subsequent operation is accomplished in a manner similar to the initial positioning of the hold-down rollers 27 described previously. A new pallet 12, having a clean upper surface, is placed beneath the scraper blades 56 in the position shown in FIGS. 1 and 2. This is done with the sub-frame 42, 44, and 45 raised upwardly in the slots 49 in each of the main side frame members 20 and 21 to permit clearance of the pallet 12. After the pallet 12 is in position, the frame member is allowed to drop to a position where the edges of the scraper blades 56 rest on the top of the pallet 12 as shown in FIG. 2. In this position, a set screw 85 is turned downwardly into the slots 49 to just bear against the upper edge of the pivot 47 as illustrated in FIG. 2. This is done for both sides of the sub-frame 42, 44, and 45. In conjunction with this adjustment, adjustments of a pivot stop, also on both sides of the sub-frame, is effected to provide a limit to the clockwise rotation of the entire scraper sub-frame assembly about the bushing on the pivot 47. This is accomplished by means of a set screw 90 threaded through a nut 91 welded or otherwise attached to the inside surfaces of the plates 20 and 21 on opposite sides of the apparatus.

The set screw 90 and nut 91 attached to the inner surface of the frame 20 is shown clearly in FIG. 2. The ends of the set screws 90 bear against the lower edges of the plates 44 and 45 (plate 44 is shown in FIG. 2) to set the clockwise limit of rotation of the scraper sub-frame assembly. This adjustment, in conjunction with the vertical adjustment, is made as a one-time static adjustment with a new pallet 12 beneath the scraper blades. After the set screws 85 and 90 are adjusted to set the desired vertical and angular position of the scraper blades 56 on the pallet 12, a nut 48 on each of the pins 47 is used to tighten the pivot pins 47, passing through the bushings 46 in the extensions 44 and 45, in place in the slots 49 to prevent the pins 47 from dropping into the bottom parts of the slots 49 after the pallet 12 is moved out of engagement with the scrapers 56.

After the initial adjustment of the apparatus is made as described above, pallets 12 are fed in the normal manner from the pallet magazine 10 to the mold box portion of the concrete block-making machine and pass beneath the scraper blades 56 as they do this. There is no need for any cam mechanisms or other mechanisms to lift the scrapers 56 and their associated holders and sub-frame assemblies up out of the path of a new pallet as spaced-apart pallets 12 are fed to the mechanism. Little or no resistance is encountered by a new pallet passing beneath the scraper blades 56 because they are held in place just at the upper surface of the pallet by virtue of the initial or set-up adjustments. If, however, the front edge of a pallet should stike a scraper blade 56, it simply causes a clockwise pivoting of the scraper blade 56 and the associated holder 50/51 against the action of the corresponding spring 67, to pivot the blade 56 upwardly (clockwise as viewed in FIG. 2) until the blade 56 rests on the top of the corresponding pallet 12, which then continues its passage beneath the scraper mechanism. The initial or set-up angle at which the scraper blades 56 and their associated holders 50/51 are oriented with respect to vertical is approximately 15 degrees, as is readily apparent from an examination of FIG. 2. Because of the manner in which the spring 67 is arranged with respect to the pivot provided by the pin 62, the force F parallel to the surface of the pallets 12 traveling beneath the scraper blades 56 is relatively light compared to the downward force D obtained from the same spring 67 for each of the different scraper blade holders. This is because the distance A (shown in FIG. 2) is considerably less than the distance B (also indicated on FIG. 2). The distance A is measured between the line of contact of the blades 56 and a perpendicular line passing through the axes of the pins 62 (a perpendicular projection of these axes on the surface of the pallet 12). Thus, the axes of the pins 62 are located the distance A in front of the line of contact of the blades 56 on the surface of the pallet 12.

In an actual commerical application of a scraper-blade device of the type shown in the drawings, the force F is adjusted to approximately 205 pounds, resulting in a corresponding force D of 1,387 pounds through the action of a single spring 67 for each of the different blade holders. The downward pressure D (the higher of these two forces) is essential to a good scraping or cleaning action on the top of the pallets 12. At the same time, the maximum force F in the direction of travel of the pallets is considerably less at 205 pounds, which prevents any undue strain from being applied to the scraper mechanism, the pallets themselves, or to the mechanism used to move the pallets from one part of the concrete block-making machine to another. The angle (approximately 15 degrees as mentioned previously) of tilt of the blades 56 in conjunction with the remainder of the mounting assembly which is illustrated permits this to take place.

If an obstruction such as a warped pallet or excessive build-up, which cannot be scraped off by the scraper blade 56 with reasonable force, is encountered as the pallet 12 is pushed by the dog 14 beneath the scraper, the blade 56 and its associated blade holder 50/51 simply moves in the clockwise direction of the arrow G upwardly and out of the way as the obstruction passes beneath that particular scraper blade. The maximum force to do this is force F. Each of the four scraper blades works independently of the other; so that conventional scraping action of the other three blades continues to take place, even if an immovable obstruction is encountered by one of the blades 56.

At the same time, the extremely large downward force D to any obstruction above the surface of the pallet 12 is applied by virtue of the spring 67.

The pivot 62 and use of the spring 67 along with the angular displacement of the scraper blades 56 prevents jamming of the machine even if large obstructions, warps, or even two pallets (one on top of another) should happen to be fed through the scraper mechanism of the machine. At the same time, extremely effective and continuous cleaning of pallets 12 used in the machine is accomplished by virtue of the downward pressure maintained by the scraper mechanism.

Frequently, in the operation of concrete block-making machines, accidental or intentional reversal of the movement of pallets 12 through the machine takes place. Such a reversal for the mechanism shown in FIGS. 1 and 2 would be a movement of the pallets 12 from left to right instead of the right to left movement which takes place during normal operation of the machine. In prior art pallet-cleaning devices, it is necessary to lift the pallet-scraper blades up out of engagement with the pallet surface before any such reversal takes place. If this is not done, the dogs 14 may be damaged, the blades 56 may be broken, or the holding lugs 58, for removably holding the blades 56 in place in the slots 52, are broken or torn out of their mountings. If this occurs in a concrete block-making machine pallet scraper, the result is costly down time to repair the damage or an inoperative scraper if the block-making machine continues to be run subsequently without repairing the scraper. Such damage does not occur with apparatus shown in FIGS. 1 and 2.

In the event a reversal of the machine should take place causing the pallet 12 to push against the blades 56 in the left to right direction, the entire assembly pivots on the bushings 46 in the counter-clockwise direction (arrow H) away from the stops 90. In normal operation, the assembly attains the position shown in FIG. 2 by virtue of the fact that the center of gravity of the scraper assembly is to the right of the pin 47 (as viewed in FIG. 2). There is nothing to impede counter-clockwise movement of the assembly once this gravity bias is overcome. Thus, the assembly pivots counter-clockwise (or to the right as viewed in FIG. 2) and upwardly to harmlessly permit a pallet 12 to move in the reverse direction under the assembly even if no precautionary measures are taken by the operators of the machine to prevent damage to the scraper mechanism. This is a significant advantage over prior art machines which are highly susceptible to considerable scraper-blade damage if a proper sequence of operation is not followed by an operator in the event of a pallet reversal.

The mechanism which permits safe operation of the machine during a reversal of direction of the pallet-drive mechanism also may be employed to pivot the blades 56 and the blade holder plates 51 upwardly to a position where the blades may be repaired or replaced from above the machine rather than from beneath as is common with most pallet-scraper mechanisms. To do this, the hold-down wheels 27 and their brackets 28 must be removed. This is quickly and easily done, however, since both of these brackets 28 (on the insides of each of the plates 20 and 21) simply may be removed by removing the bolts 34 and lifting the brackets 28 out of the machine. Then, the entire sub-frame assembly 42, 44, 45 and the associated blade holders may be pivoted fully counter-clockwise until the upper edges of the shock absorber holder brackets 70 and 71 rest against the upper surface of the tube 24. The blades 56 and their hold-down lugs 58 are exposed for whatever repair or maintenance then needs to be accomplished. After this is done, a reversal of the procedure places the machine back in condition for normal operation.

Although the invention has been described in conjunction with the preferred embodiment illustrated in the drawings, it will be understood by those skilled in the art that this embodiment is illustrative only of the invention, and various changes and modifications can be made without departing from the scope of the invention. For example, more or less scraper blades and blade holders may be used in place of the four which are illustrated. Different types of hinges or pivots may be employed, and modifications in the shape and structural arrangement (such as placing the blades under pallets) of some of the parts of the assembly may be required to accommodate the inventive concept to different types of concrete block-making machinery. Also, it may occur to those skilled in the art to use the mechanism for other applications than the cleaning of pallets used in automatic concrete block-making machines. The same principles of the invention apply to such other uses.

We claim:

1. A device for cleaning pallets as the pallets are moved from one location to another, said device including in combination:

a frame mounted in a fixed location relative to the path of travel of pallets to be cleaned;

a pivot means;

blade holder means pivotally attached to said frame through said pivot means for limited rotational movement relative thereto;

a pallet scraper blade mounted in said blade holder means in a scraping position near the surface of a pallet to be cleaned; and spring means for yieldably mounting said blade holder means and said scraper blade to permit rotation thereby about said pivot means against said spring means in response to a first force perpendicular to the pallet surface and in response to a second force in a plane parallel to the pallet surface in the direction of movement of a pallet past said scraper blade, the axis of said pivot means being a predetermined distance above and in front of the line of contact of said pallet scraper blade in the normal direction of movement of pallets past said device during the cleaning operation.

2. The combination according to claim 1 wherein said first force is substantially greater than said second force.

3. The combination according to claim 2 wherein said first force is approximately six times greater than said second force.

4. The combination according to claim 1 wherein said first and second forces are provided by a common resilient spring means.

5. A device for cleaning pallets of the type used in concrete block making machines and adapted to be located above pallets moved from a first position on one side of said device to a second position on the other side of said device, said device including in combination;

a main frame mounted in a fixed position relative to the path of movement of pallets to be cleaned;

a sub-frame pivotally mounted on said main frame on a first pivot means and located near the surface of a pallet to be cleaned;

a pivot stop fixedly attached to said main frame and located to engage said sub-frame;

said sub-frame engaging sid pivot stop during the cleaning of a pallet;

a second pivot means;

blade holder means pivotally attached to said sub-frame means through said second pivot means for limited rotational movement relative thereto;

a scraper blade mounted in said blade holder means in a scraping position near the surface of a pallet to be cleaned; and means for yieldably mounting said blade holder means and said scraper blade to permit rotation thereby about said second pivot means in response to a first force perpendicular to the pallet surface and in response to a second force in a plane parallel to the pallet surface in the direction of movement of a pallet being cleaned by said device.

6. The combination according to claim 5 wherein said first force is substantially greater than said second force.

7. The combination according to claim 6 wherein said first force is approximately six times greater than second force.

8. The combination according to claim 5 wherein the axis of said first pivot is a predetermined distance behind the line of contact of said pallet scraper blade in the normal direction of movement of pallets beneath said device during the cleaning operation, and said sub-frame and said blade and said blade holder means carried thereby are rotatable about said first pivot away from said stop in a direction opposite to the normal direction of movement of pallets to be cleaned.

9. The combination according to claim 8 wherein the relative location of said first pivot and said scraper blade are such that in the event of reverse travel of a pallet in said opposite direction, said scraper blade is pivoted with said sub-frame about said first pivot.

10. The combination according to claim 9 wherein said sub-frame and said blade holder and scraper blade may be pivoted away from said pivot stop to a position locating said scraper blade to a position permitting access thereto from the top of said device for replacement and repair.

11. The combination according to claim 5 wherein the axis of said second pivot means is a predetermined distance in front of the line of contact of said pallet scraper blade in the normal direction of movement of pallets beneath said device during the cleaning operation.

12. The combination according to claim 11 wherein said first and second yieldable forces are provided by a common resilient spring means and shock absorber means for dampening the action of said spring means.

* * * * *